US009345367B2

(12) United States Patent
Keily et al.

(10) Patent No.: US 9,345,367 B2
(45) Date of Patent: May 24, 2016

(54) MULTI-FUNCTION PAPER TOWELING DISPENSER

(71) Applicant: DISPENSING DYNAMICS INTERNATIONAL, City of Industry, CA (US)

(72) Inventors: Joel P. Keily, Corona, CA (US); Niko Anthony Cvjetkovic, Los Alamitos, CA (US)

(73) Assignee: Dispensing Dynamics International, City of Industry, CA (US)

( * ) Notice: Subject to any disclaimer, the term of this patent is extended or adjusted under 35 U.S.C. 154(b) by 125 days.

(21) Appl. No.: 14/170,695

(22) Filed: Feb. 3, 2014

(65) Prior Publication Data

US 2015/0216376 A1 Aug. 6, 2015

Related U.S. Application Data

(63) Continuation-in-part of application No. 12/658,681, filed on Feb. 12, 2010, now abandoned, which is a continuation-in-part of application No. 12/455,121, filed on May 27, 2009, now Pat. No. 8,382,026.

(51) Int. Cl.
*B65H 63/08* (2006.01)
*A47K 10/36* (2006.01)

(52) U.S. Cl.
CPC ..... *A47K 10/3625* (2013.01); *A47K 10/3637* (2013.01); *A47K 10/3643* (2013.01); *A47K 2010/3668* (2013.01)

(58) Field of Classification Search
CPC ..... A47K 10/24; A47K 10/34; A47K 10/36; A47K 10/3687; B65H 35/006
USPC ..... 242/563, 563.2, 564, 564.4, 565
See application file for complete search history.

(56) References Cited

U.S. PATENT DOCUMENTS

| | | | |
|---|---|---|---|
| 3,715,085 | A | 2/1973 | Kobayashi et al. |
| 3,730,409 | A | 5/1973 | Ratti |
| 3,737,087 | A | 6/1973 | Rooklyn |
| 3,949,918 | A | 4/1976 | Golner et al. |
| 3,998,308 | A | 12/1976 | Yeakley |
| 4,122,738 | A | 10/1978 | Granger |
| 4,170,390 | A | 10/1979 | McCabe |
| 4,270,818 | A | 6/1981 | McCabe |
| 4,573,750 | A | 3/1986 | Golby |
| 4,666,099 | A | 5/1987 | Hoffman et al. |
| 4,676,131 | A | 6/1987 | Cassia |
| 4,717,043 | A | 1/1988 | Groover et al. |
| 4,721,265 | A | 1/1988 | Hawkins |
| 4,738,176 | A | 4/1988 | Cassia |
| 4,790,490 | A | 12/1988 | Chakravorty |
| 4,796,825 | A | 1/1989 | Hawkins |

(Continued)

FOREIGN PATENT DOCUMENTS

| | | |
|---|---|---|
| WO | WO9959457 | 11/1999 |
| WO | WO0063100 | 10/2000 |

*Primary Examiner* — William A Rivera
(74) *Attorney, Agent, or Firm* — Thomas R. Lampe

(57) ABSTRACT

A paper toweling dispenser includes an electric motor driven toweling support roller, a handle for rotating the toweling support roller and a one-way clutch including a stabilized pawl, which allows the handle to rotate the toweling support roller only in a single direction of rotation transporting toweling on the toweling support roller to an exit opening of the dispenser when the electric motor does not drive the toweling support roller.

1 Claim, 14 Drawing Sheets

(56) References Cited

U.S. PATENT DOCUMENTS

| | | | | |
|---|---|---|---|---|
| 4,826,262 | A | 5/1989 | Hartman et al. | |
| 4,848,854 | A | 7/1989 | Kennedy | |
| 4,960,248 | A | 10/1990 | Bauer et al. | |
| 5,131,302 | A | 7/1992 | Watanabe | |
| 5,244,263 | A | 9/1993 | Kennedy | |
| 5,335,811 | A | 8/1994 | Morand | |
| 5,340,045 | A | 8/1994 | Arabian et al. | |
| 5,375,920 | A | 12/1994 | Macchi Cassia | |
| 5,417,783 | A | 5/1995 | Boreali et al. | |
| 5,441,189 | A | 8/1995 | Formon et al. | |
| 5,452,832 | A | 9/1995 | Niada | |
| 5,630,526 | A | 5/1997 | Moody | |
| 5,657,945 | A | 8/1997 | Bryant | |
| 5,691,919 | A | 11/1997 | Gemmell et al. | |
| 5,772,291 | A | 6/1998 | Byrd et al. | |
| 5,816,514 | A | 10/1998 | Duclos et al. | |
| 5,878,381 | A | 3/1999 | Gemmell et al. | |
| 6,012,664 | A | 1/2000 | Duclos et al. | |
| 6,079,305 | A | 6/2000 | Bloch et al. | |
| 6,105,898 | A | 8/2000 | Byrd et al. | |
| 6,112,631 | A | 9/2000 | Vanalstine | |
| 6,206,322 | B1 * | 3/2001 | Elliott | A47K 10/36 192/17 R |
| 6,314,850 | B1 | 11/2001 | Morand | |
| 6,363,824 | B1 | 4/2002 | Granger | |
| 6,412,655 | B1 | 7/2002 | Stuetzel et al. | |
| 6,412,679 | B2 | 7/2002 | Formon et al. | |
| 6,419,136 | B2 | 7/2002 | Formon et al. | |
| 6,446,901 | B1 | 9/2002 | Haen et al. | |
| 6,553,879 | B2 | 4/2003 | Morand | |
| 6,592,067 | B2 | 7/2003 | Denen et al. | |
| 6,695,246 | B1 | 2/2004 | Elliott et al. | |
| 6,820,785 | B2 | 11/2004 | Kapiloff | |
| 6,854,684 | B2 | 2/2005 | Byrd et al. | |
| 6,892,620 | B2 | 5/2005 | Kapiloff | |
| 6,977,588 | B2 | 12/2005 | Schotz et al. | |
| 6,988,689 | B2 | 1/2006 | Thomas et al. | |
| 7,044,421 | B1 | 5/2006 | Omdoll et al. | |
| 7,168,602 | B2 | 1/2007 | Broehl | |
| 7,182,288 | B2 | 2/2007 | Denen et al. | |
| 7,296,765 | B2 | 11/2007 | Rodrian | |
| 7,325,767 | B2 | 2/2008 | Elliott et al. | |
| 7,325,768 | B2 | 2/2008 | Byrd et al. | |
| 7,341,170 | B2 | 3/2008 | Boone | |
| 7,354,015 | B2 | 4/2008 | Byrd et al. | |
| 8,082,827 | B2 * | 12/2011 | Friesen | A47K 10/36 83/337 |
| 8,382,026 | B2 * | 2/2013 | Keily | A47K 10/34 242/563 |
| 8,528,851 | B2 * | 9/2013 | Friesen | A47K 10/36 242/563 |
| 8,657,225 | B2 * | 2/2014 | Hagleitner | A47K 10/36 242/564.4 |
| 2007/0079684 | A1 * | 4/2007 | Friesen | A47K 10/36 83/649 |

* cited by examiner

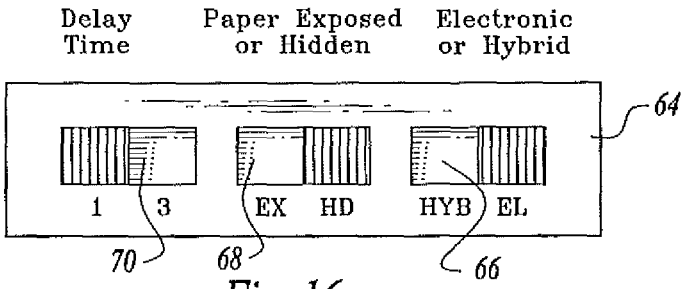
Fig. 16
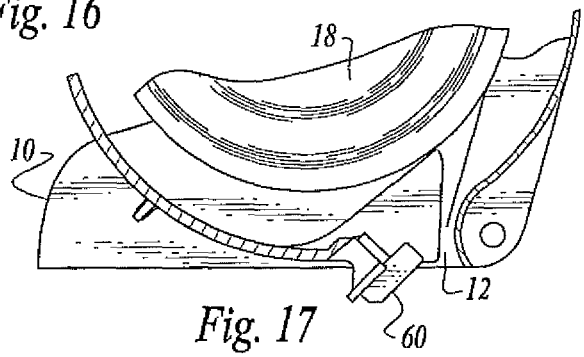
Fig. 17
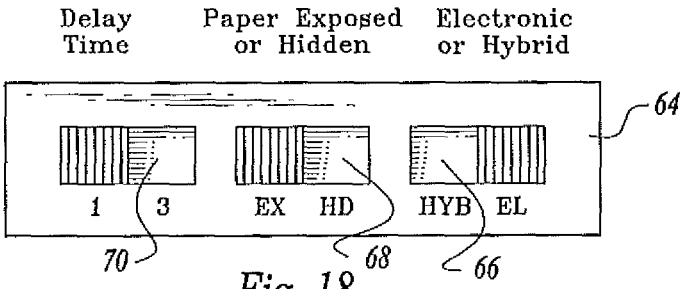
Fig. 18
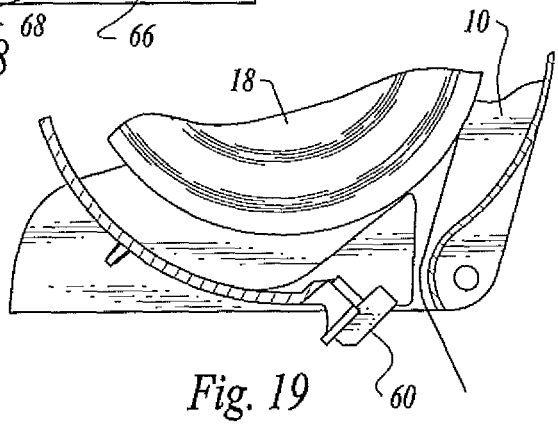
Fig. 19
Fig. 20
| | |
|---|---|
| Fig. 20A | Fig. 20B |
| Fig. 20C | Fig. 20D |

MULTI-FUNCTION PAPER TOWELING DISPENSER

This application is a continuation-in-part of U.S. patent application Ser. No. 12/658,681, filed Feb. 12, 2010, U.S. patent application Ser. No. 12/658,681 is a continuation-in-part of U.S. patent application Ser. No. 12/455,121, filed May 27, 2009.

TECHNICAL FIELD

This invention relates to apparatus selectively operable to dispense paper toweling from a roll of paper toweling employing a plurality of alternative operational modes. The apparatus includes an interconnection between a towel support roll and a manually movable handle including a one-way clutch whereby the handle can only rotate the roller in a single direction of rotation.

BACKGROUND OF THE INVENTION

Many dispenser systems are known in the prior art for dispensing paper toweling from rolls thereof. In some cases, the paper toweling is comprised of individual paper towel segments separated by perforated tear lines, and in others the toweling has no perforated tear lines formed therein, severing or cutting individual sheets from the toweling accomplished by some suitable severing structure incorporated in the dispenser.

Many towel dispensers of a purely mechanical nature have been developed and utilized over the years for dispensing paper towels, including dispensers which are actuated by a user grasping and pulling on a tail of the toweling extending from the dispenser housing.

For example, U.S. Pat. Nos. 6,314,850 and 6,553,879 disclose apparatus for dispensing paper toweling including a rotatable toweling support roller and a cutter blade pivotally mounted on the outer peripheral portion of the roller. The blade is movable between a first position in which the cutting edge of the blade is positioned closely adjacent to the outer peripheral portion and a second position in which the blade is disposed at an angle relative to the outer peripheral portion with the cutting edge of the blade spaced from the toweling support roller. The cutter blade when in the second position projects in a direction generally opposed to the direction of rotation of the toweling support roller. Pulling force exerted on the toweling by a user not only serves to rotate the toweling support roller but also causes the toweling to bear against the cutting edge of the cutter blade to sever the toweling.

The apparatus of U.S. Pat. Nos. 6,314,850 and 6,553,879 has met with considerable commercial success; however, some problems with "tabbing" have occurred during use of the dispenser. Tabbing occurs when a piece of towel tears from the sheet when a user grasps and pulls the paper. Tabbing may occur with one or two hand pulls. Papers that absorb water at the greatest rate are most likely to tab, the rate of water absorbency varying by paper manufacturer and grade. Tabbing also becomes a particular problem when low basis weight paper is to be dispensed. It is not an exaggeration to say that virtually all paper towel dispensers of a purely mechanical nature which rely on direct pulling of the toweling by a user to transport the toweling and actuate moveable cutter or severing blades have a tabbing problem to some extent.

Electro-mechanical dispensers employing an electric motor to transport toweling and actuate cutter mechanisms are also well known. Such arrangements include both dispensers which are manually actuated, as by means of a push button and those employing a sensor, such as a sensor sensing proximity of a user's hand, to initiate operation.

U.S. Pat. No. 6,820,785, issued Nov. 23, 2004, discloses an electro-mechanical roll towel dispenser including a housing with a roll carrier disposed therein to rotatably support a roll of towel material. An electro-mechanical feed mechanism is disposed in the housing to dispense measured sheets of the towel material. The feed mechanism operates in a first mechanical operational mode wherein the towel sheets are dispensed by a user grasping and pulling on a tail of the towel material extending from the housing, and a second electrical operational mode wherein a measured length of a next sheet is automatically fed from the housing to define the tail for the next user.

The dispenser of U.S. Pat. No. 6,820,785 includes a sensor for detecting a parameter that is changed by an initial pull exerted on a tail of a web of material extending from the opening of the dispenser. The sensor also generates a signal sent from the sensor to a control circuit or circuitry causing the motor employed in the apparatus to drive the feed mechanism until a measured length of web material that includes the tail of web material has been fed from the dispenser in the form of a measured sheet for subsequent removal by the user.

Similar devices are disclosed in U.S. Pat. No. 3,730,409 and Patent Publication Document WO 00/63100. The devices of these latter two documents have sensors for detecting movement of a tail end of web material such that the feed mechanism is activated in response to detecting the movement. Co-pending U.S. patent application Ser. No. 12/290,220, filed Oct. 28, 2008, discloses paper toweling dispenser apparatus incorporating a motor which reduces pull force which must be exerted by a user of the apparatus during dispensing. Initial transport of the toweling is accomplished by the user exerting a pull force of very low magnitude. On the other hand, when cutting of toweling is occurring, which normally requires application of a relatively high pull force, during which tabbing is most likely, an electric motor employed in the apparatus provides assistance, reducing the pull force that would otherwise have to be applied by a consumer.

In addition, the apparatus of U.S. patent application Ser. No. 12/290,220 incorporates dual mode functioning; that is, when the batteries normally utilized to energize the motor deplete, toweling can still be cut and accessed by a user rotating a feed knob to advance the tail. The user can remove the sheet by pulling on the tail as usual. A key to maintaining low pull force in this mode is to disengage the gear motor from the toweling support roller through the use of a one-way clutch bearing or other clutch system such as pawls.

The user can manually turn the feed knob or handle until the sheet is cut and advanced. If the toweling is completely cut by the cutting mechanism, the severed sheet can be fully advanced and can be removed by the user without pulling required or, of the toweling is partly severed, the user can rotate the knob to advance a tail and then pull on the tail. In addition, the knob may be utilized to rotate the toweling support roller and toweling thereon until the motor is energized, rather than the user directly manually applying pulling forces on the tail to accomplish this.

The following documents are also believed to be representative of the current state of the prior art in this field: U.S. Pat. No. 3,715,085, issued Feb. 6, 1973, U.S. Pat. No. 3,730,409, issued May 1, 1973, U.S. Pat. No. 3,737,087, issued Jun. 5, 1973, U.S. Pat. No. 3,949,918, issued Apr. 13, 1976, U.S. Pat. No. 3,998,308, issued Dec. 21, 1976, U.S. Pat. No. 4,666,099, issued May 19, 1987, U.S. Pat. No. 4,676,131, issued Jun. 30, 1987, U.S. Pat. No. 4,721,265, issued Jan. 26, 1988, U.S. Pat. No. 4,738,176, issued Apr. 19, 1988, U.S. Pat. No. 4,790,490, issued Dec. 13, 1988, U.S. Pat. No. 4,796,825, issued January, 1989, U.S. Pat. No. 4,960,248, issued Oct. 2, 1990, U.S. Pat. No. 5,131,302, issued Jul. 21, 1992, U.S. Pat. No. 5,452,832, issued Sep. 26, 1995, U.S. Pat. No. 5,772,291, issued Jun. 30, 1998, U.S. Pat. No. 6,079,305, issued Jun. 27, 2000, U.S. Pat. No. 6,105,898, issued Aug. 22, 2000, U.S. Pat. No. 6,412,655, issued Jul. 2, 2002, U.S. Pat. No. 6,412,679, issued Jul. 2, 2002, Patent Document No. WO 9959457, dated November, 1999, Patent Document No. WO 0063100, dated October, 2000, U.S. Pat. No. 7,398,944, issued Jul. 15, 2008, U.S. Pat. No. 6,892,620, issued May 17, 2005, U.S. Pat. No. 7,044,421, issued May 16, 2006, U.S. Pat. No. 4,573,750, issued Mar. 4, 1986, U.S. Pat. No. 4,826,262, issued May 2, 1989, U.S. Pat. No. 6,446,901, issued Sep. 10, 2002, U.S. Pat. No. 4,270,818, issued Jun. 2, 1981, U.S. Pat. No. 6,112,631, issued Sep. 5, 2000, U.S. Pat. No. 5,375,920, issued Dec. 27, 1994, U.S. Pat. No. 7,354,015, issued Apr. 8, 2008, U.S. Pat. No. 4,738,176, issued Apr. 19, 1988, U.S. Pat. No. 4,790,490, issued Dec. 13, 1988, U.S. Pat. No. 6,079,305, issued Jun. 27, 2000, U.S. Pat. No. 6,419,136, issued Jul. 16, 2002, U.S. Pat. No. 6,412,679, issued Jul. 2, 2002, U.S. Pat. No. 5,441,189, issued Aug. 15, 1995, U.S. Pat. No. 5,878,381, issued Mar. 2, 1999, U.S. Pat. No. 5,691,919, issued Nov. 25, 1997, U.S. Pat. No. 5,452,832, issued Sep. 26, 1995, U.S. Pat. No. 5,340,045, issued Aug. 23, 1994, U.S. Pat. No. 5,335,811, issued Aug. 9, 1994, U.S. Pat. No. 5,244,263, issued Sep. 14, 1993, U.S. Pat. No. 4,848,854, issued Jul. 18, 1989, U.S. Pat. No. 4,738,176, issued Apr. 19, 1988, U.S. Pat. No. 4,270,818, issued Jun. 2, 1981, U.S. Pat. No. 4,170,390, issued Oct. 9, 1979, U.S. Pat. No. 5,657,945, issued Aug. 19, 1997, U.S. Pat. No. 4,122,738, issued Oct. 31, 1978, U.S. Pat. No. 6,012,664, issued Jan. 11, 2000, U.S. Pat. No. 5,816,514, issued Oct. 6, 1998, U.S. Pat. No. 5,417,783, issued May 23, 1995, U.S. Pat. No. 4,717,043, issued Jan. 5, 1988, U.S. Pat. No. 5,630,526, issued May 20, 1997, U.S. Pat. No. 6,363,824, issued Apr. 2, 2002, U.S. Pat. No. 6,293,486, issued Sep. 25, 2001, U.S. Pat. No. 6,695,246, issued Feb. 24, 2004, U.S. Pat. No. 6,854,684, issued Feb. 15, 2005, U.S. Pat. No. 6,988,689, issued Jan. 24, 2006, U.S. Pat. No. 7,325,767, issued Feb. 5, 2008, U.S. Pat. No. 7,325,768, issued Feb. 5, 2008, U.S. Pat. No. 7,168,602, issued Jan. 30, 2007, U.S. Pat. No. 6,592,067, issued Jul. 15, 2003, U.S. Pat. No. 7,341,170, issued Mar. 11, 2008, U.S. Pat. No. 7,182,288, issued Feb. 27, 2007, U.S. Pat. No. 7,296,765, issued Nov. 20, 2007, U.S. Pat. No. 6,977,588 issued Dec. 20, 2005 and U.S. Pat. No. 6,820,785, issued Nov. 23, 2004.

DISCLOSURE OF INVENTION

The present invention relates to a multi-function paper towel dispenser selectively operable to dispense paper toweling from a roll of paper toweling employing a plurality of alternative operational modes. The desired mode of operation can be selected utilizing control switches associated with sensor structure and electronic control circuitry of the dispenser. The multi-function paper towel dispenser is characterized not only by its versatility, but by its relative simplicity, ease of use and reliability in any of the operational modes selected. Two of the modes are a paper hidden mode and a paper exposed mode, each of which utilizes sensor structure in combination with electronic control circuitry to operate an electric motor driven rotatable toweling support roller to partially cut and dispense the paper toweling. The electric motor is also utilized to rotate the paper toweling support roller when not employing the sensor structure, the motor essentially operating in a hybrid mode wherein a pull force exerted on the toweling tail initiates rotation of the toweling support roller, the electric motor then being energized to reduce the pull force required by a user to effect final dispensing of a towel. Furthermore, a user can manually rotate the paper toweling support roller to effect dispensing of a towel in any of the modes.

The sensor structure of the multi-function paper towel dispenser is operatively associated with the electric motor to energize the electric motor and cause rotation of the toweling support roller to transport the paper toweling for dispensing from the dispenser in either a first mode of operation wherein the electric motor is energized responsive to the sensor structure sensing positioning of a user's hand at a predetermined location external of the housing or in a second mode of operation wherein the electric motor is energized responsive to the sensor structure sensing the removal of a toweling tail from a location external of the housing.

The electronic control circuitry for operating the dispenser in either the first mode of operation or in the second mode of operation utilizes simple, reliable mechanical switches as compared to electronic switches that are controlled by logic controller/programmable chips, the case in the prior art wherein programmable logic electronics are employed. Programmable logic is required because fixed parameters are not employed. Because the present invention has fixed parameters and utilizes discrete digital logic instead of programmable logic, no controller chip is required, simple resistors and capacitors being utilized along with the use of mechanical electric switches versus electronic switches. As will be seen below, the invention incorporates a number of other unique features, including energy saving features and a one-way clutch interconnection between a toweling support roller and a manually rotatable handle allowing the handle to rotate the roller in a single direction only.

While it is generally known to employ one-way clutch mechanisms in association with rotatable handles of towel dispensers wherein dispensing is solely accomplished by using the handles to rotate toweling support rollers, as exemplified by U.S. Pat. No. 6,314,850 discussed above, in the present invention a one-way clutch is employed in a novel manner in association with a motor driven paper toweling support roller controlled by electronic control circuitry.

Other features, advantages and objects of the present invention will become apparent with reference to the following description and accompanying drawings.

BRIEF DESCRIPTION OF DRAWINGS

FIG. 16 is a view similar to FIGS. 6 and 11, but illustrating different control switch positions;

FIG. 17 shows the condition of a toweling tail when hidden as selected by the middle control switch in FIG. 16;

FIG. 18 illustrates the middle switch moved to a position that results in the tail being exposed;

FIG. 19 shows the toweling tail exposed and extending from the bottom of the dispenser housing;

FIG. 20 depicts relative positioning of four segments of the electronic control circuitry of the invention as shown in FIGS. 20A, 20B, 20C and 20D;

MODES FOR CARRYING OUT THE INVENTION

Figure 1:
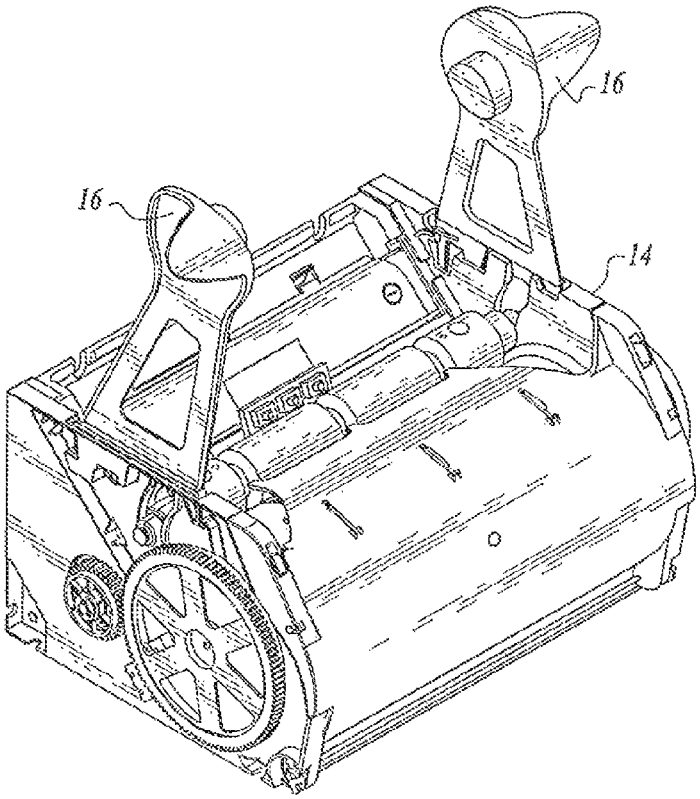
FIG. 1 is a front, perspective view illustrating internal components of a multi-function paper toweling dispenser constructed in accordance with the teachings of the present invention.

Referring now to the drawings, a multi-function paper towel dispenser constructed in accordance with the teachings of the present invention is illustrated. As explained and disclosed in greater detail below, the dispenser is selectively operable to dispense paper toweling from a roll of paper toweling employing a plurality of alternative operational modes.

The paper towel dispenser includes a housing 10 (shown in FIGS. 3, 9-10, 13, 14, 17, 19 and 22-26), the housing having a towel dispensing opening 12 at the bottom thereof.

Mounted in the interior of the housing 10 is an assembly 14 (see FIGS. 1-3) including operational structural components of the multi-function paper towel dispenser. These structural elements include a roll support in the form of spaced support arms 16 insertable into the open ends of a supply roll of paper toweling in a conventional fashion.

A rotatable toweling support roller 18 has a cylindrically-shaped outer peripheral surface and is rotatable in a predetermined direction of rotation a cutter blade 20 (see FIGS. 10 and 24) has attached to the ends thereof cam followers 22 (see FIGS. 3 and 24), each including a cam follower arm and roller. Each roller rides in a channel of a cam 24. Cams 24 are located at both ends of the assembly 14, it being understood that the channels of these cams are directed inwardly.

The blade, cam follower and cam system employed are suitably that disclosed in co-pending U.S. patent application Ser. No. 12/290,220, filed Oct. 28, 2008 as well as in U.S. Pat. Nos. 6,314,850 and 6,553,879, the teachings of which are incorporated by reference into this application.

Rotation of toweling support roller 18 will cause the cam followers to move along the cam surfaces defining the channels. This, in turn, will cause the cutter blade 20 to pivot relative to the toweling support roller 18.

The cutter blade is movable between an inactive position wherein the cutter will not sever the toweling and a severing position (see FIG. 24) wherein the cutter blade is positioned outwardly of the toweling support roller to at least partially sever the toweling on the toweling support roller. An electric motor 30 is operatively associated with the toweling support roller for selectively rotating the toweling support roller. A mechanical electric switch 32 is operatively associated with the electric motor and with the toweling support roller. The electric switch is electrically connected to the electric motor, with no control circuit boards intermediate the electric motor and the electric switch.

Similar to the arrangement disclosed in co-pending U.S. patent application Ser. No. 12/290,220, the electric switch 32 is responsive to rotation of the toweling support roller 18 by a user of the dispenser from a rest or inactive position to a first position to energize the electric motor when the toweling support roller reaches the first position and cause rotation of the toweling support roller by the electric motor from the first position to a second position and reducing the pull force required by a user pulling the paper toweling during rotation of the toweling support roller between the first position and the second position. Further, the mechanical electrical switch 32 is responsive to rotation of the toweling support roller beyond the second position to deenergize the electric motor. This mode of operation, sometimes hereinafter referred to as a hybrid or third mode of operation, is described in more detail below.

Mechanical electric switch 32 includes a switch actuator element 34 having a roller 36 at the end thereof which is biased into engagement with a circular end 38 of the toweling support roller 18. The switch actuator element 32 alternatively opens or closes the switch during rotation of the toweling support roller.

Located at circular end 38 of the toweling support roller and engaged by the switch actuator element roller during rotation of the toweling support roller is an arcuate projection 40. The projection extends only part way along the periphery of the toweling support roller and has two tapered projection ends 42. Extending completely about circular end 38 and disposed inwardly of the arcuate projection is a toweling support roller gear 44 having teeth. Meshing with the teeth of the toweling support roller gear are teeth of a drive gear 46 which is driven by electric motor 30, the latter suitably being in the form of a DC gear motor. A one-way clutch needle bearing 48 connects the drive gear to the electric motor to allow the performance of certain functions indicated below. Electric wiring connects the switch 32 to the electric motor. The mechanical electric switch 32 is located between the electric motor and a source of DC power in the form of electric batteries (not shown).

Figure 6:
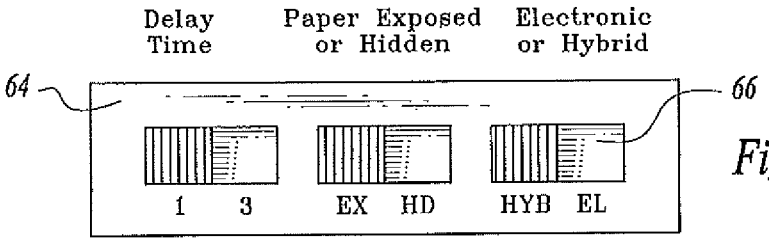
FIG. 6 is a plan view illustrating a switch panel having mode selection control switches and a time delay control switch.
Figure 7:
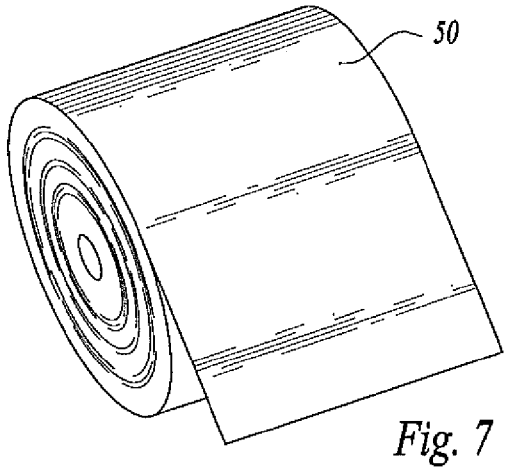
FIG. 7 is a perspective view of an unperforated supply roll of toweling that may be utilized in the multi-function paper towel dispenser.

FIGS. 6-10 may now be referred to in connection with operation of the multi-function paper towel dispenser in the third or hybrid mode. In such mode the roll of uncut or unperforated toweling 50 as shown in FIG. 7 would be used as the supply roll. FIG. 6 shows the setting of a control switch 66 to the hybrid setting, the hybrid mode of operation being but one of the mode of operation options, as will be explained in greater detail below.

Figure 8:
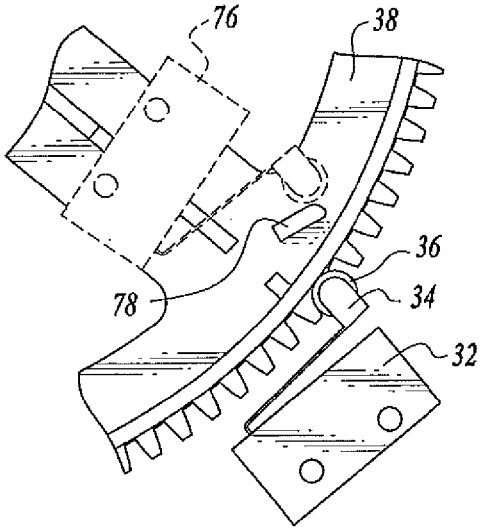
FIG. 8 is a greatly enlarged, side view illustrating a portion of the drive gear of the toweling support roller and its relationship with mechanical electric switches, one of which is shown in solid lines and the other in dash lines.
Figure 9:
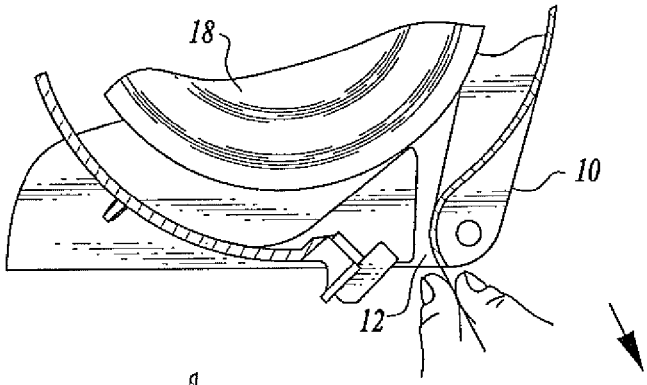
FIG. 9 shows a towel tail being grasped and dispensed when the control switches are in the positions shown in FIG. 6.

FIG. 8 shows mechanical electric switch 32 being utilized in this mode of operation as indicated above. FIG. 9 shows a user manually grasping the tail of the toweling and pulling it to initiate rotation of the toweling support roller 18. Further pulling of the toweling energizes the electric motor to power rotation of the toweling support roller when the switch 32 is closed.

Figure 10:
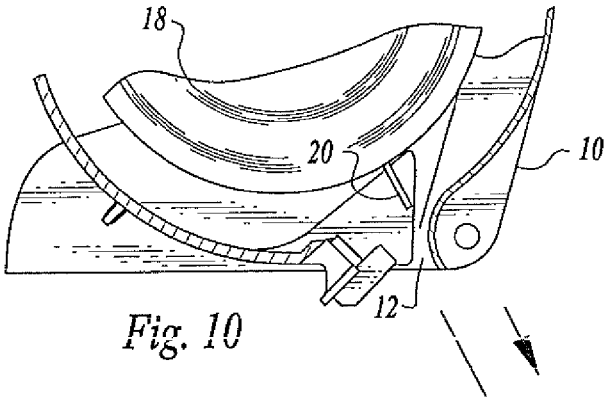
FIG. 10 illustrates the positioning of the toweling after a towel sheet has been removed by the user.

FIG. 10 illustrates a severed toweling section removed from the dispenser and a new tail moving into place to extend to a position under the housing where it can be manually grasped and pulled by the next user.

The toweling tail may be brought to such position by manually rotating the toweling dispenser roller 18 by a rotatable manually engageable element in the form of a handle or knob 54 connected to the toweling support roller. A one-way clutch (described immediately below) is employed to ensure that the toweling support roller is being rotated in the direction necessary to advance toweling. The handle 54 can also be used to advance and dispense the toweling if the batteries fail. The user can pull on the tail as usual when not utilizing the apparatus without motor assistance. In this situation, the required pull force is still relatively low since the gear motor is in effect disengaged from the toweling support roller by employing a one-way clutch needle bearing or some other one-way clutch mechanism.

FIGS. 27-31 illustrate connector structure including a one-way clutch operatively connecting handle 54 to the toweling support roller enabling the handle upon application of manual force thereto to drive and rotate the toweling support roller only in a single predetermined direction of rotation. Rotation of the toweling support roller in the predetermined direction of rotation transports any toweling supported by the toweling support roller to dispense the toweling.

The connector structure includes a projection in the form of a spindle 100 attached to and extending from the toweling support roller 18 at the axis of rotation thereof. A receptacle 102 is attached to the handle 54 and receives the projection 100. The projection and the receptacle are locked against relative rotational movement by a key and notch arrangement, as illustrated. A spring member 104 is wrapped about the outer cylindrical surface of receptacle 102 and in engagement therewith. The spring member 104 and the receptacle 102 comprise a one-way clutch.

The spring member 104 has a plurality of concentric coils wrapped about and engaging the cylindrical surface. The spring member has a spring end 106 connected to a peg 108 affixed to the housing structure.

Figure 30:
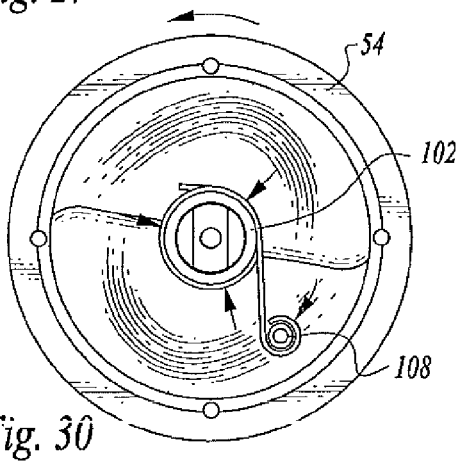
FIG. 30 is a schematic view showing the spring being tightened about a receptacle attached to the handle to resist turning of the handle.

The coils tighten about the receptacle to form a tight frictional engagement between the spring member and the outer cylindrically shaped surface of the receptacle to prevent rotational movement of the handle and the toweling support roller in a rotational direction other than the single predetermined direction of rotation resulting in toweling dispensing. This is shown in FIG. 30. In other words, the single predetermined direction of rotation is that which will result in transport of the paper toweling toward the dispenser exit opening.

Figure 31:
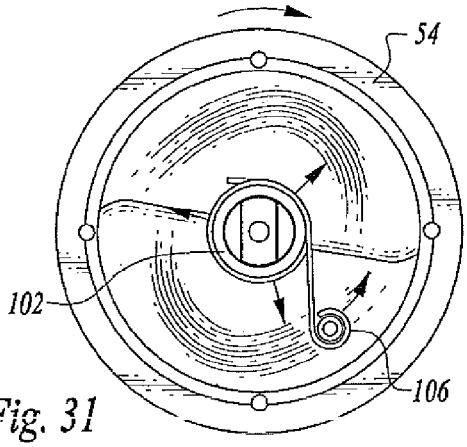
FIG. 31 is a view showing the spring untightened and allowing rotation of the handle in a different direction of rotation.

FIG. 31 shows the handle (and of course the toweling support roller) rotating in the single predetermined direction of rotation resulting in dispensing of the toweling, the coils of the spring member 104 loosening as indicated by the arrows to readily allow this to occur. This action is a result of the spring coils being wrapped about the receptacle in the direction opposed to the single predetermined direction of rotation.

Handle 54 has a configuration encouraging a user to rotate the handle (and the toweling support roller) in the single predetermined direction of rotation. The handle 54 has an outer wall 130 defining recesses 132 for receiving fingers of a user rotating the handle. Each of the recesses is defined by an inwardly directed flat outer wall finger engagement surface 134 that is easy to push and an adjoining curved wall surface 136 which is difficult to push.

Figure 32:
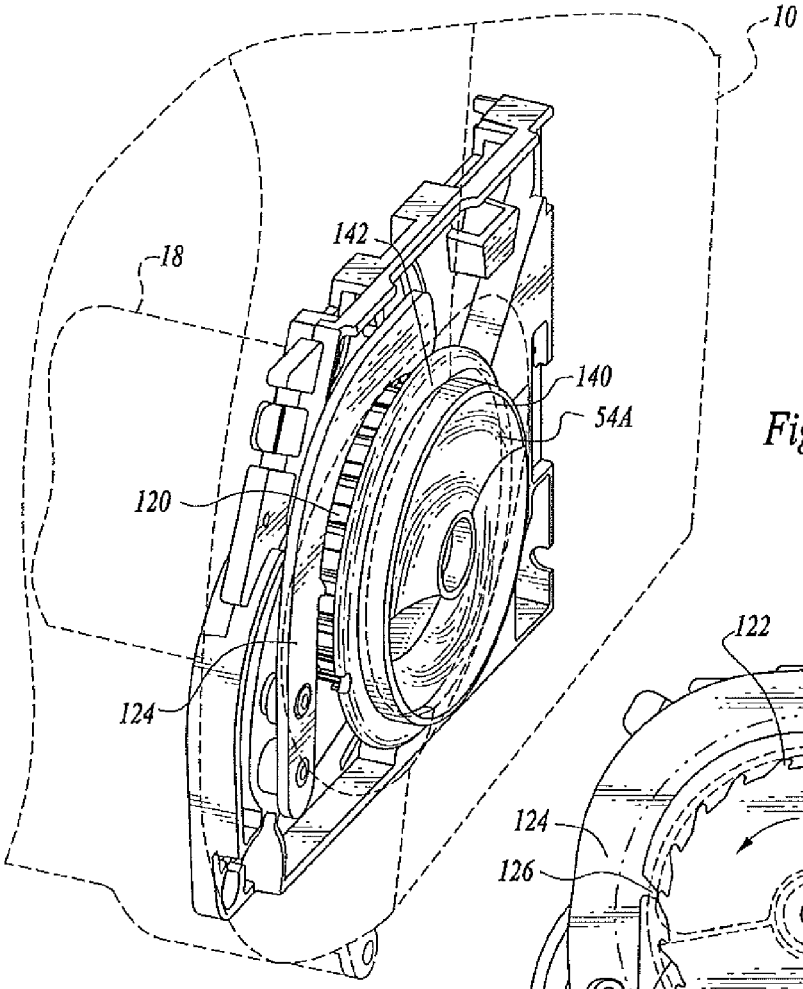
FIG. 32 is a perspective view similar to FIG. 27, but showing an alternative embodiment of one-way clutch including a pawl.
Figure 33:
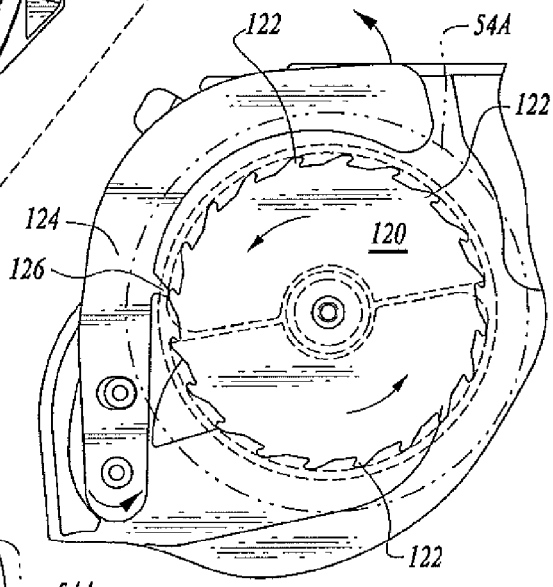
FIG. 33 is a side elevational view showing the pawl in a position allowing rotation of the handle.
Figure 34:
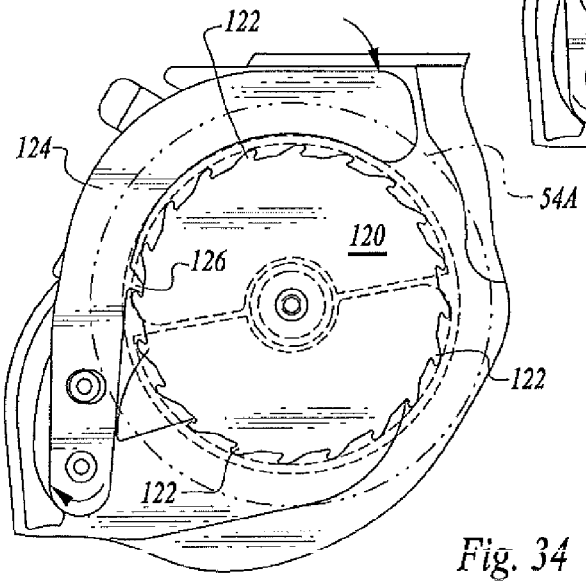
FIG. 34 is a view similar to FIG. 33 showing the pawl preventing rotation of the handle in the opposite direction of rotation.
Figure 35:
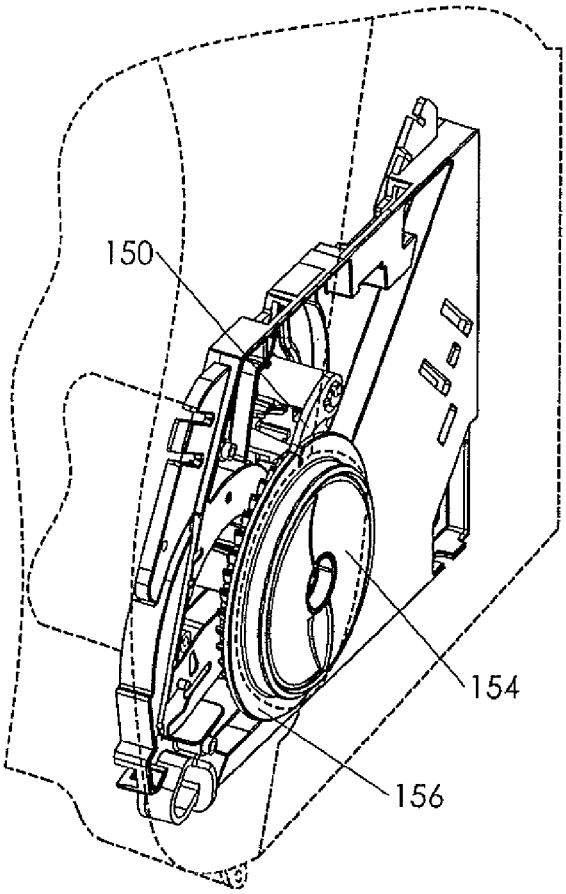
FIG. 35 is a perspective view similar to FIG. 32, but showing yet another embodiment of the invention.
Figure 36:
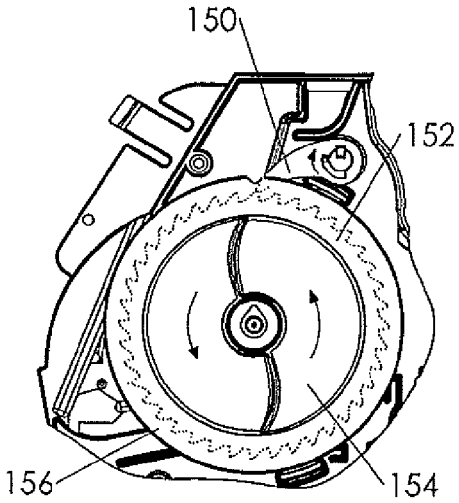
FIG. 36 is a side elevational view of the FIG. 35 embodiment showing the pawl thereof allowing rotation of the knob in counter-clockwise direction.
Figure 37:
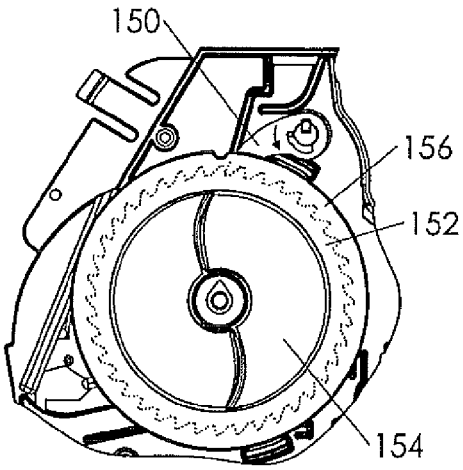
FIG. 37 is a view similar to FIG. 36, but the pawl in a position blocking the knob against clockwise movement.
Figure 38:
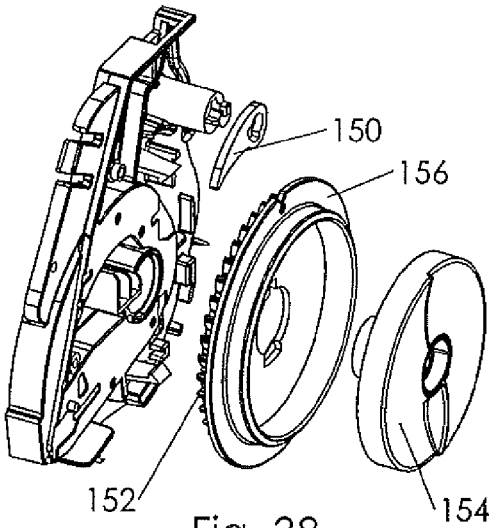
FIG. 38 is an exploded, perspective view of the embodiment of FIG. 35.

FIGS. 32-34 disclose an alternative embodiment of connector structure including a one-way clutch operatively connected with the handle enabling the handle upon application of manual force thereto to drive and rotate the toweling support roller only in a single predetermined direction of rotation. In the arrangement of FIGS. 32-34 the one-way clutch includes a circular member 120 attached to rotate with the handle 54A about an axis of rotation and also rotate the toweling support roller 18. A plurality of spaced projections 122 having projection distal ends are disposed about the periphery of the circular member 120, adjacent projections defining notches.

A pivotally mounted pawl 124 is located adjacent to the circular member and pivotal relative to the housing in a plane orthogonal to the axis of rotation of the handle. The pawl 124 is engageable with the projections 122 to prevent rotational movement of the handle 54A and the toweling support roller 18 in a rotational direction other than the single predetermined direction of rotation resulting in the desired transport of the toweling on the roller. FIG. 33 illustrates the handle rotating in the desired direction as indicated by the arrows. The pawl is positioned so that a projection engagement pawl portion including a detent 126 on the pawl extends toward and engages the projections or teeth 122 to raise the pawl and relative movement between the circular member and the pawl is still allowed. The projection engagement pawl extends toward the circular member in a plane orthogonal to the axis of rotation and aligned with the plane of the circular member. When, however, the direction of the circular member is reversed, the pawl falls under the influence of gravity as indicated by the arrow in FIG. 34 to fall into a notch between two projections and stop rotation of the handle and the associated toweling support roller.

The rotatable manually engageable handle 54A has a manually engageable outer handle portion 140 located outside said housing spaced from said circular member 120 and said projections and a non-manually engageable inner handle portion positioned between said projections and said outer handle portion, said inner handle portion comprising a circular wall 142 having an inner wall surface extending radially outwardly in a direction orthogonal to said axis of rotation beyond the projection distal ends, said pivotally mounted pawl 124 positioned so that said projection engagement pawl portion extends toward said circular member alongside the inner wall surface of said circular wall 142 in a plane orthogonal to said axis of rotation and aligned with the plane of said circular member.

The circular wall and its placement relative to the pawl and to the projections serve to protect and shield the pawl at the location of engagement with the projections. This provides protection and stability for the pawl structure so that it will operate for an extended period of time without damage or operational failure due for example to misalignment or change in pawl position.

FIGS. 35-38 disclose yet another embodiment of the invention which is similar to the arrangement shown in FIGS. 32-34 and relates to a one-way clutch employing a pivotally mounted pawl 150 employed with circular member 152 having projection thereon rotatable with the toweling support roller (not shown in FIGS. 35-38). The pawl 150 is smaller and lighter than pawl 124 of the FIGS. 32-34 embodiment. Pawl 150 has a lower moment of inertia, allowing a quicker response, and likely quicker engagement with the circular member.

In this latter embodiment the handle outer portion 154 is illustrated as being separable from the inner handle portion including circular wall 156, however these components can be formed in a single-piece.

Like the FIGS. 32-34 embodiment, the circular wall 156 and its placement relative to pawl 150 and to the projections serve to protect and shield pawl 150 at the location of engagement with the projections, providing protection and stability for the pawl structure so that it will operate for an extended period of time without damage or operational failure, due for example to misalignment or change in pawl position.

The multi-function paper towel dispenser incorporates sensor structure operatively associated with the electric motor to energize the electric motor and cause rotation of the toweling support roller to transport the paper toweling for dispensing. This sensor structure is utilized in conjunction with electronic control circuitry in a manner which will now be described. When the dispenser is in its hybrid or third mode of operation described above, the sensor structure and electronic control circuitry are not utilized.

The sensor structure is identified by reference numeral 60 and employs a "bouncing" technology in the infrared spectrum that bounces a wave off a hand or paper to activate the unit. That is, the sensor structure is operatively associated with the electric motor to energize the electric motor and cause rotation of the toweling support roller to transport the paper toweling for dispensing from the multi-function paper toweling dispenser in either a first mode of operation wherein the electric motor is energized responsive to the sensor structure sensing positioning of a user's hand or other object at a predetermined location external of the housing or in a second mode of operation wherein the electric motor is energized responsive to the sensor structure sensing the removal of a toweling tail from a location external of the housing.

FIGS. 20A-20D disclose the schematic of electronic control circuitry which may be utilized to carry out the desired electronic functions. It is important to note that the control circuitry utilizes no programmable logic electronics as compared to prior art devices which require programmable logic to operate because they do not have fixed parameters. Because the present invention operates with fixed parameters, mechanical switches can be utilized rather than electronic switches that are controlled by a logic controller/programmable chip. In other words, the present invention employs discrete digital logic in the electronic circuitry instead of programmable logic. Simple resistors and capacitors are utilized instead, these being located on a circuit board 62 electrically connected between the sensor 60 and the electric motor 30.

The control switch panel 64 and control switches shown in FIGS. 6, 11, 16, and 18 are associated with the electronic circuit board and utilized to select the various modes in which the multi-function paper towel dispenser can operate. Switch 66 is employed to switch between the hybrid mode of operation described above and an electronic mode of operation wherein the sensor structure 60 and control circuitry are utilized to operate the dispenser in either a paper hidden mode (hereinafter sometimes referred to as the first mode) of operation or a paper exposed mode (sometimes hereinafter referred to as the second mode of operation). Switch 68 of the switch display selects either the paper hidden mode or the paper exposed mode. A third switch 70 is utilized to set and adjust the time delay between cycles, for example approximately one second or approximately three seconds. When the switch 66 is set to hybrid operation, the switches 68 and 70 for exposed paper or hidden paper operation and time delay adjustment are inactive.

Figure 11:
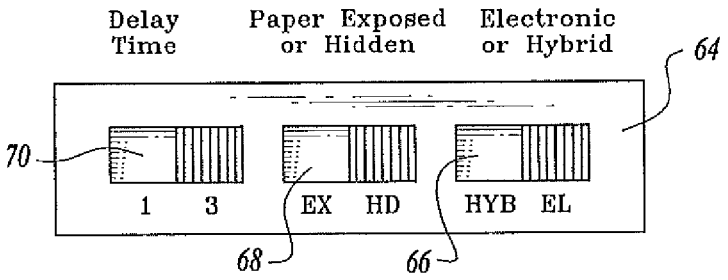
FIG. 11 is a view similar to FIG. 6, but illustrating the condition of the control switches during a different mode of operation.
Figure 13:
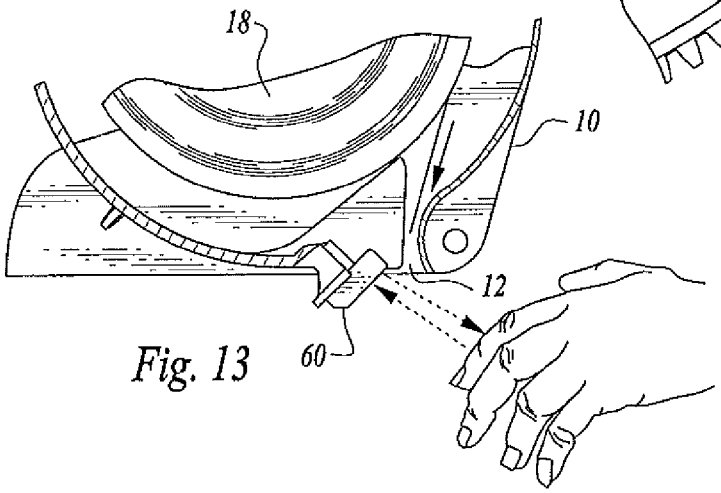
FIG. 13 is a view similar to FIG. 9, but illustrating initial dispensing of a towel in response to a sensed user's hand.
Figure 15:
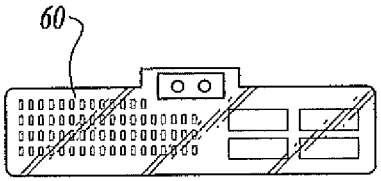
FIG. 15 is a plan view illustrating sensor structure of the multi-function paper towel dispenser.

FIG. 11 illustrates switch 66 set for electronic control and switch 68 set for the paper hidden or first mode of operation wherein the electric motor is energized responsive to the sensor structure sensing positioning of a user's hand at a predetermined location external of the housing. FIG. 13 illustrates a user's hand positioned where it can be sensed and the infrared wave transmitted by sensor structure 60 being bounced off the hand to the sensor structure receiver. This results in the control circuitry on circuit board 62 energizing the electric motor and causing rotation of the toweling support roller to move the towel tail in a downward direction as illustrated by the arrow and available for grasping and removal by the user.

A second mechanical electric switch 76 is employed when the multi-function paper towel dispenser operates in either the paper hidden mode or paper exposed mode to stop rotation of the toweling support roller when the dispensing cycle is completed. Switch 76 is fixedly mounted adjacent to toweling support roller gear 44 and is engageable during rotation of the toweling support roller by a projection 78 extending from the gear 44. Once the first and second mode mechanical electrical switch 76 is engaged by the projection 78, rotation of the toweling support roller and transport of the toweling will be halted.

During rotation of the toweling support roller the blade associated with the toweling support roller will cut the sheet, the amount of which is controlled by the position of the actuator of mechanical electric switch 76. In a preferred actuator position, the sheet is cut more than ninety percent.

This allows the user to easily remove the sheet with a very light pull force. When the sheet is removed by the user, the dispenser will not dispense another sheet until the user puts a hand under the sensor.

Figure 12:
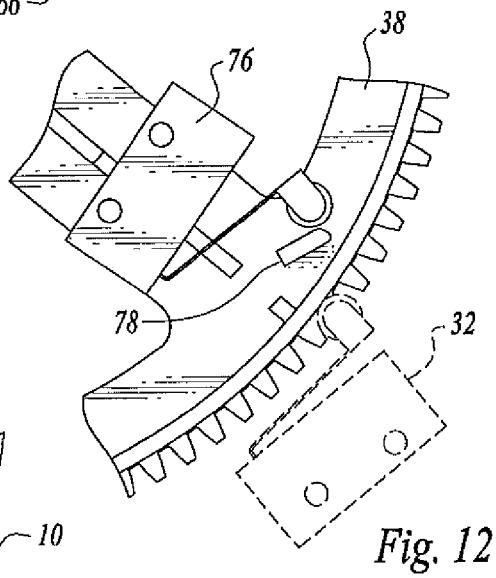
FIG. 12 is a view similar to FIG. 8, but illustrating the condition of the toweling support roller and the mechanical electric switches associated therewith in a different mode of operation as determined by the control switches in FIG. 11 wherein the electric motor is energized responsive to sensor structure sensing positioning of a user's hand.
Figure 14:
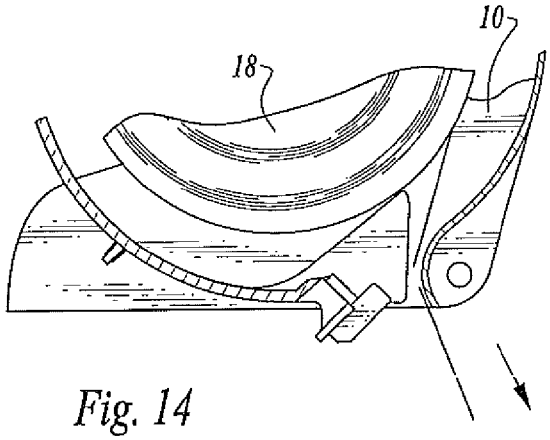
FIG. 14 illustrates a towel removed from the rest of the toweling at the end of the dispensing cycle illustrated.
Figure 20A:
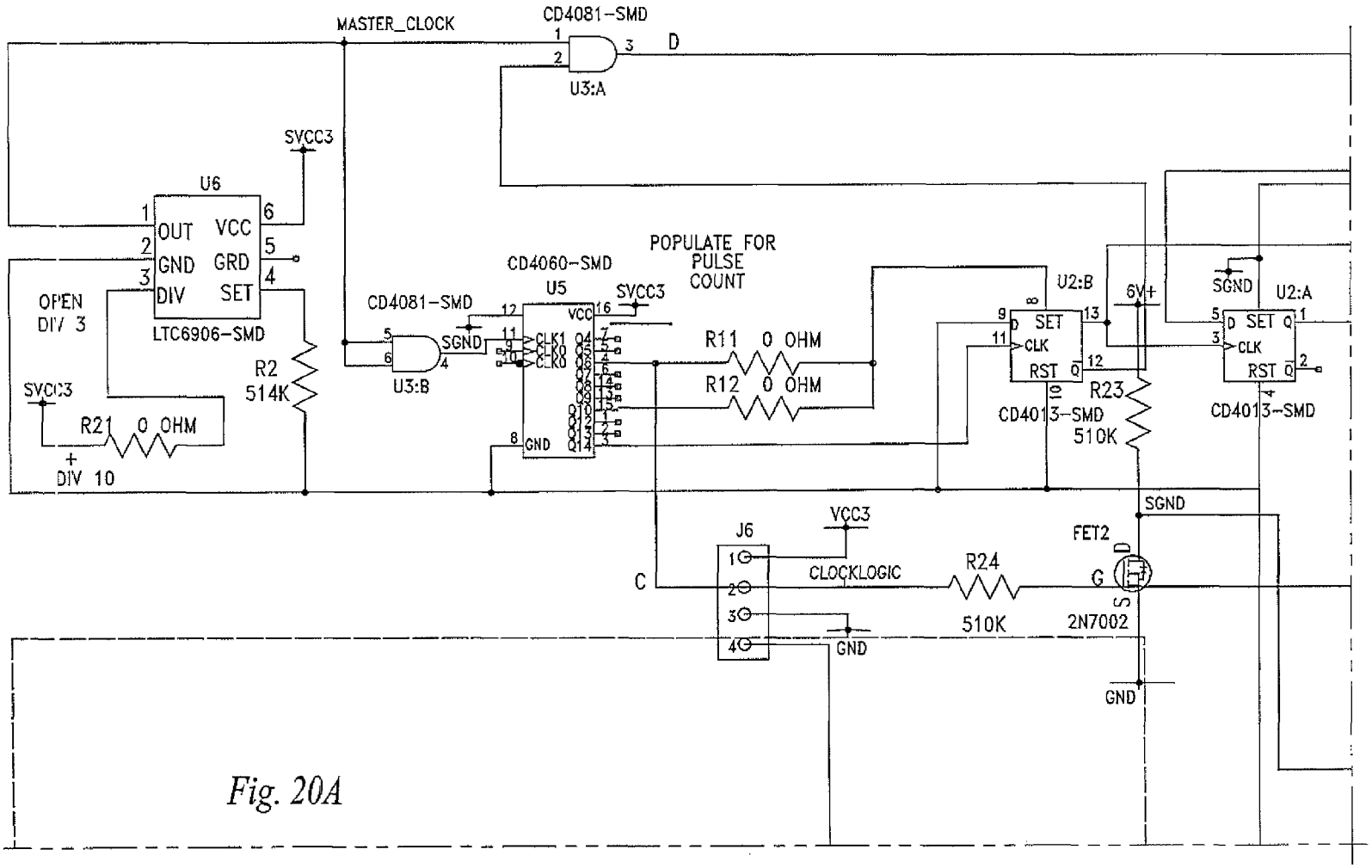
FIGS. 20A-20D illustrate these segments.
Figure 20B:
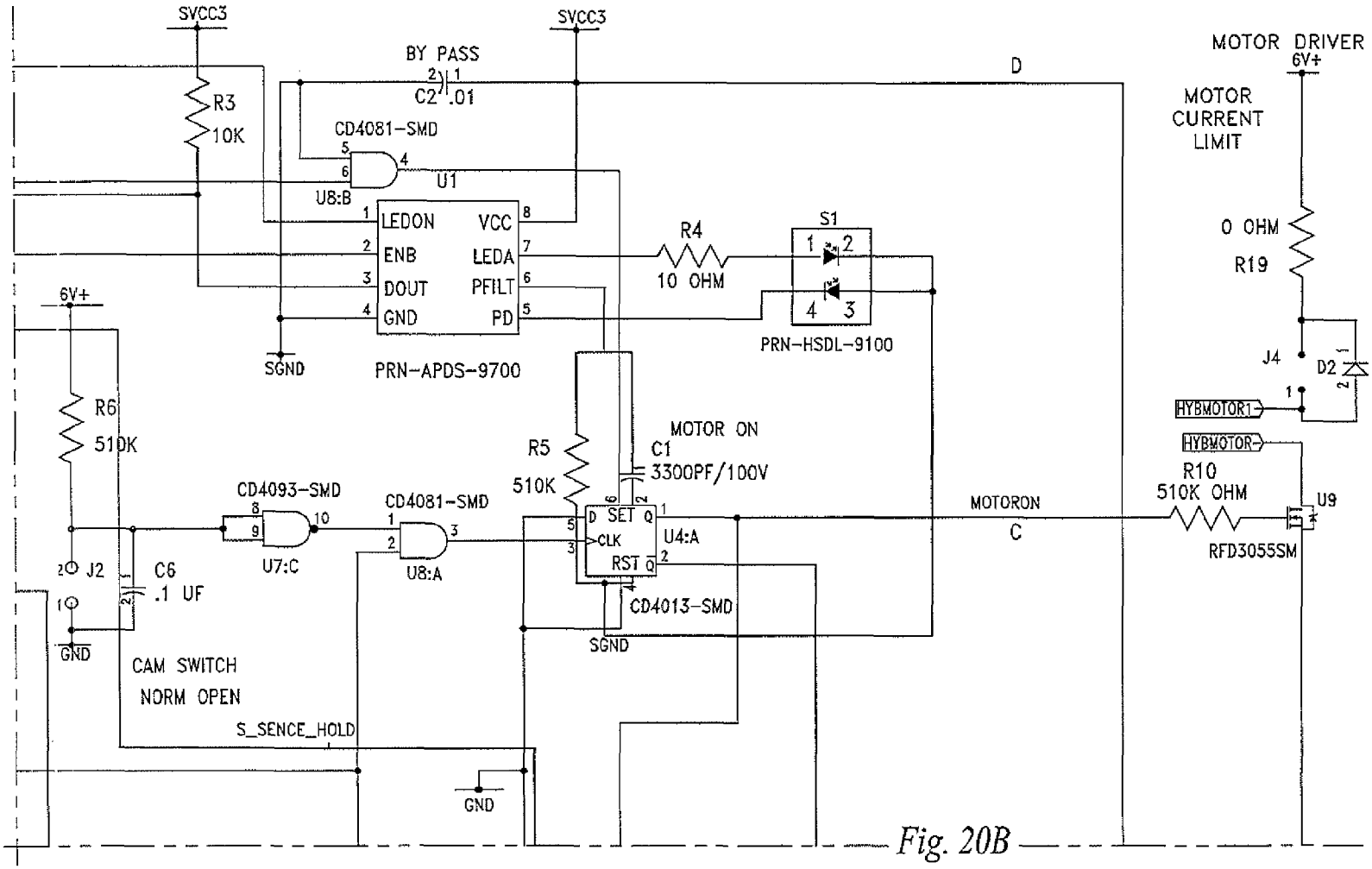
Figure 20C:
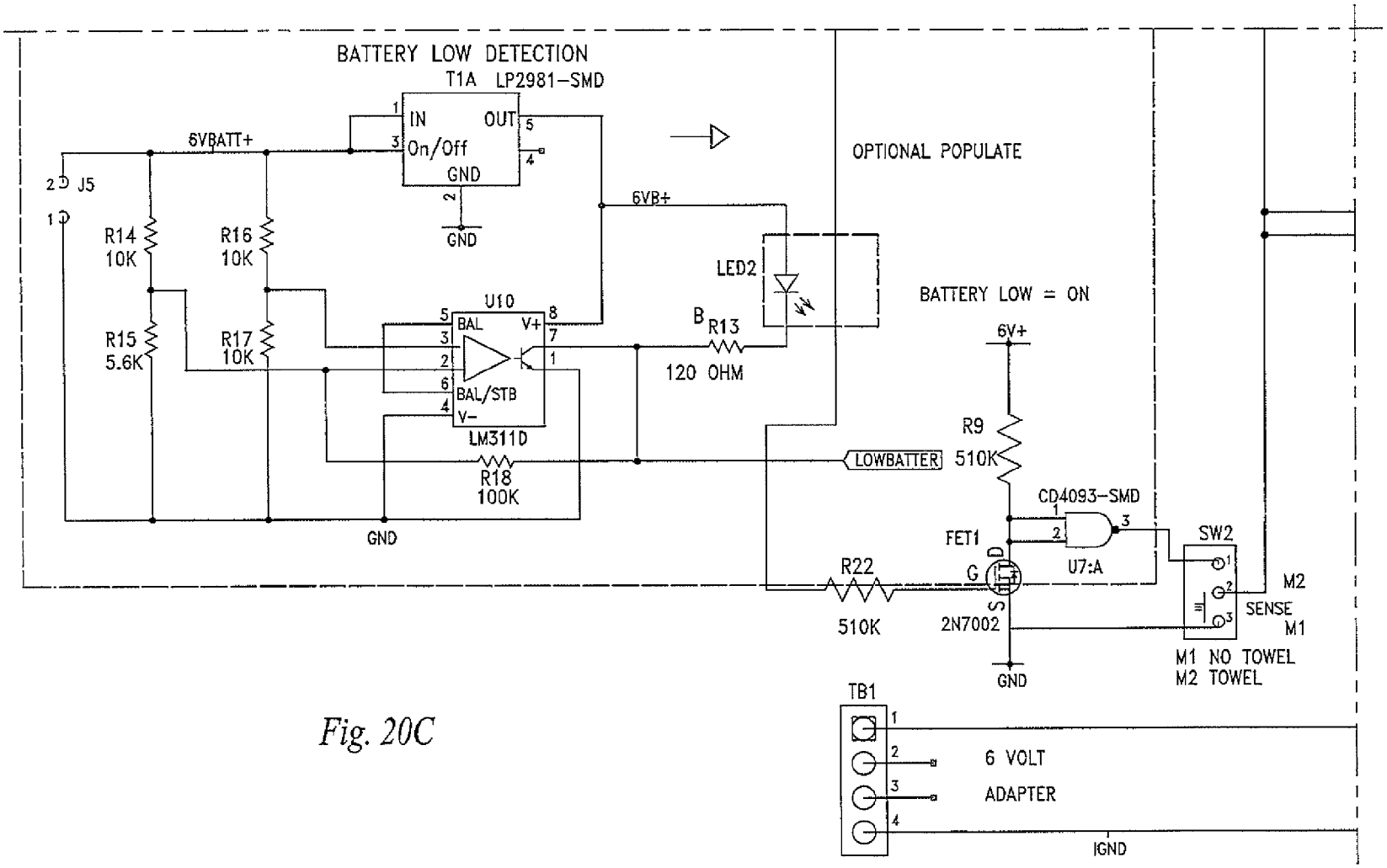
Figure 20D:
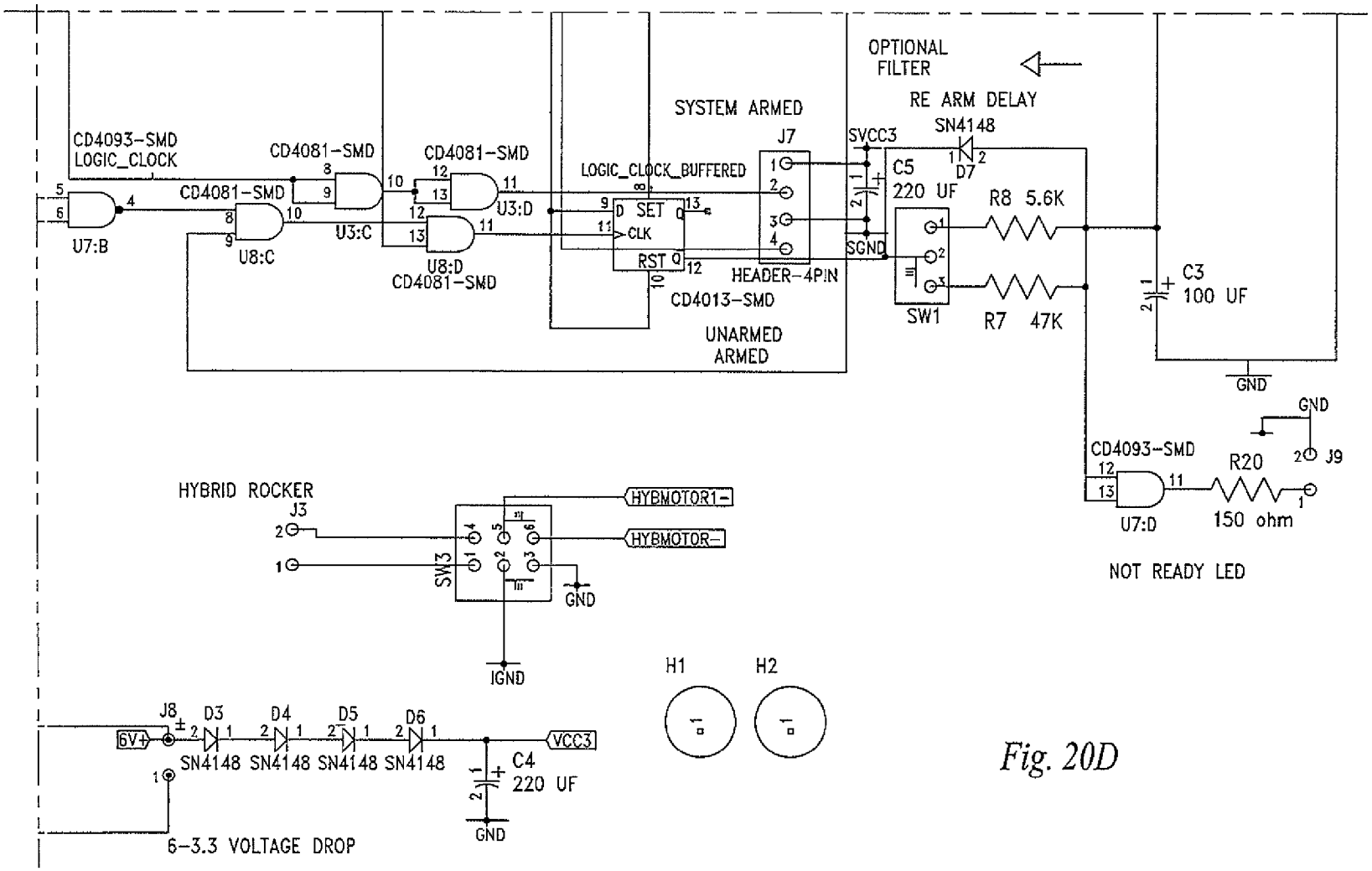
Figure 21:
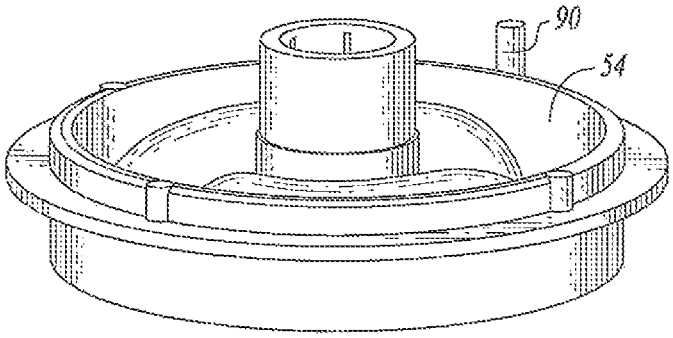
FIG. 21 is a perspective view of a manually graspable turning knob or handle employed to rotate the toweling support roller having a projection in the form of a post extending outwardly therefrom.

FIGS. 11, 12 and 14 illustrate operation in the first or paper hidden mode.

Figure 2:
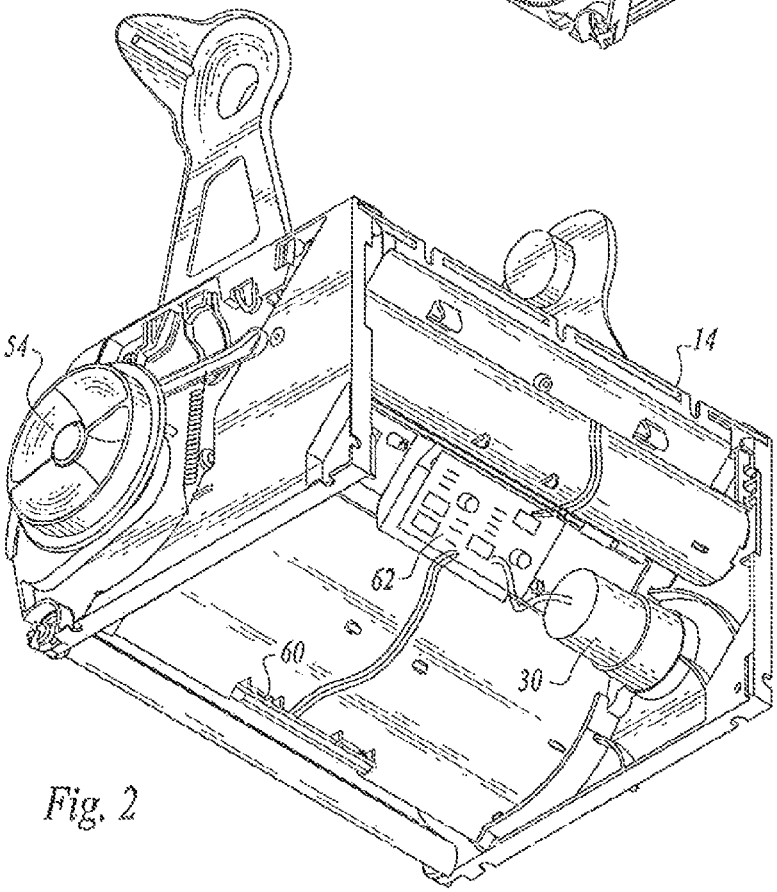
FIG. 2 is a back, perspective view of the components.
Figure 4:
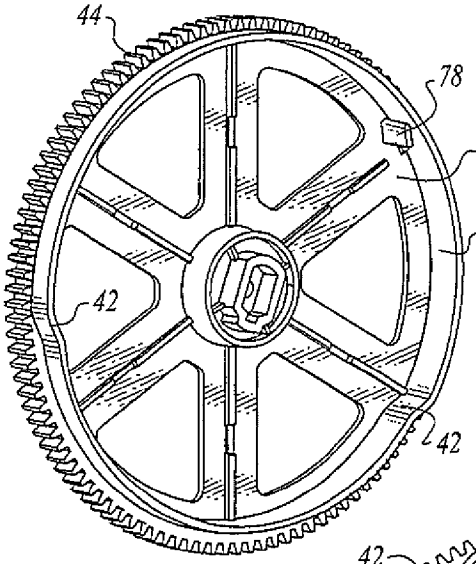
FIG. 4 is a perspective view illustrating a drive gear of the toweling support roller.
Figure 5:
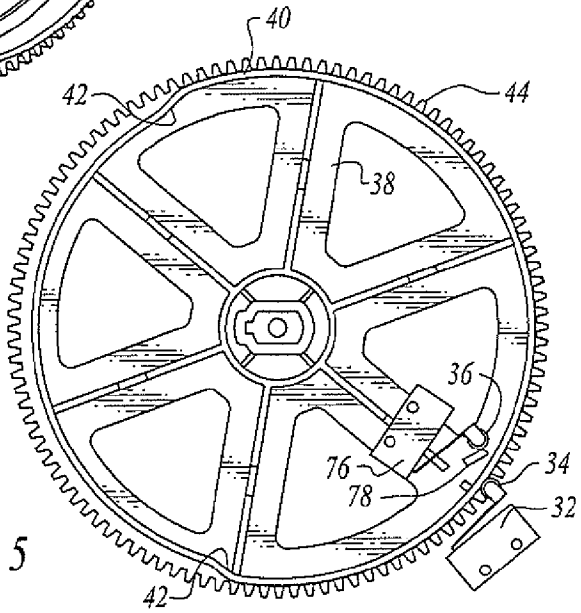
FIG. 5 is a side elevational view of the drive gear of the toweling support roller and illustrating mechanical electric switches employed therewith.
Figure 3:
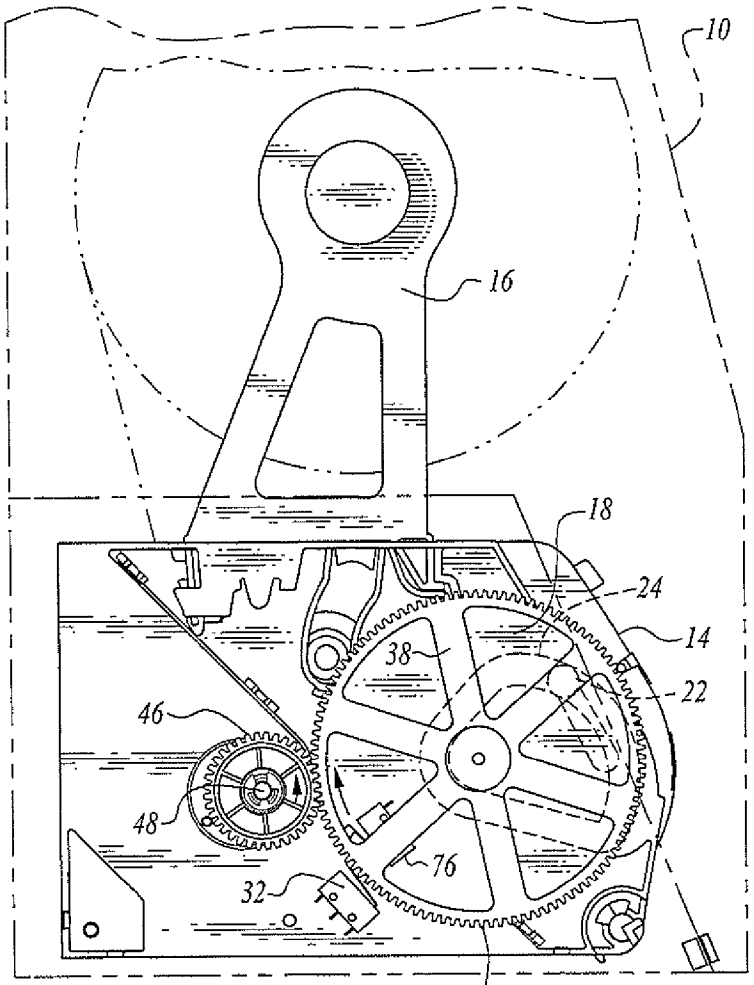
FIG. 3 is a side, elevational view showing the structure illustrated in FIG. 3 in solid lines, a housing and a supply roll of toweling being shown in phantom lines.

FIG. 16 shows the control switch panel with the control switches 66 and 68 in the same positions as shown in FIG. 11, but with switch 70 changed to a position which sets the delay time between cycles to approximately one second as compared to three seconds in FIG. 1.

FIG. 17 is a view similar to FIG. 13, but with the paper towel dispenser inactive and with the tail in a hidden position, that is in a position where the tail is essentially non-visible from outside the housing. Again, reactuation will only take place if a hand or other object is in a position relative to the housing and sensor 60 that would initiate the next cycle, which can occur after approximately a second has passed.

FIG. 18 shows the switch 66 in the electronic control position and switch 68 selecting the paper exposed or second mode of operation wherein the electric motor is energized responsive to the sensor sensing the removal of a toweling tail from a location external of the housing. In this mode the sensor is looking for the presence of a paper tail. As long as the paper tail is covering the sensor's range, the motor remains deenergized. When a user removes the hanging sheet, the lack of paper in front of the sensor will trigger the motor to turn on. The motor turns the toweling support roller until mechanical electric switch 76 is triggered by the projection 78 on the toweling support roller gear 44. Rotation of the toweling support roller will have advanced and cut the sheet, the amount of which is controlled by the switch actuator position of mechanical electric switch 76. In this mode of operation, the multi-function paper towel dispenser always has a long tail of paper hanging downwardly from the housing, for example 9 inches. In a preferred embodiment, the sheet is pre-cut more than ninety percent. This allows the user to easily remove the sheet with a very light pull force.

The arrangement described above incorporates battery saving features. By not using a controller chip the circuit board uses less electricity than would otherwise be the case. Furthermore, the sensor is not continuously on but rather is pulsed by the control circuitry, for example about five times per second. In the long run, a dispenser that sees light usage (with respect to sheets dispensed) may have a considerable percentage of its batteries drained by the circuit board. Having a board that uses less energy can extend battery life most noticeably in dispensers that are subject to low use conditions.

It has been found that while dispensing from hidden paper (first) or exposed paper (second) modes the sensor structure can be covered by a small towel tail leaving the dispenser in a less than desirable condition. This can happen for a number of reasons, including a user pulling on the exposed sheet before the motor has turned off. When this happens in the hidden mode the dispenser will not dispense a sheet even when the user puts his or her hand next to the sensor. The feed knob 54 will need to be turned to advance the sheet.

When this condition exists in the paper exposed mode, the next sheet will not automatically advance, the feed knob having to be used to advance the sheet.

FIGS. 21-26 disclose operation of structure for resolving these potential problems. In particular, stop structure is provided for operative association with the toweling support roller to temporarily stop rotation of the toweling support roller during operation of the dispenser.

The stop structure includes a pivoted stop arm 84 pivoted about pivot point 86 and biased in a downward direction as viewed in these figures by a spring 88. Knob 54, which is rotatable with the toweling support roller, has a member in the form of post 90 projecting therefrom in an inward direction. When the toweling support roller is being rotated by the electric motor 30, the knob and post 90 will also rotate as shown in FIGS. 22-25 and the post engages portions of the arm.

Figure 22:
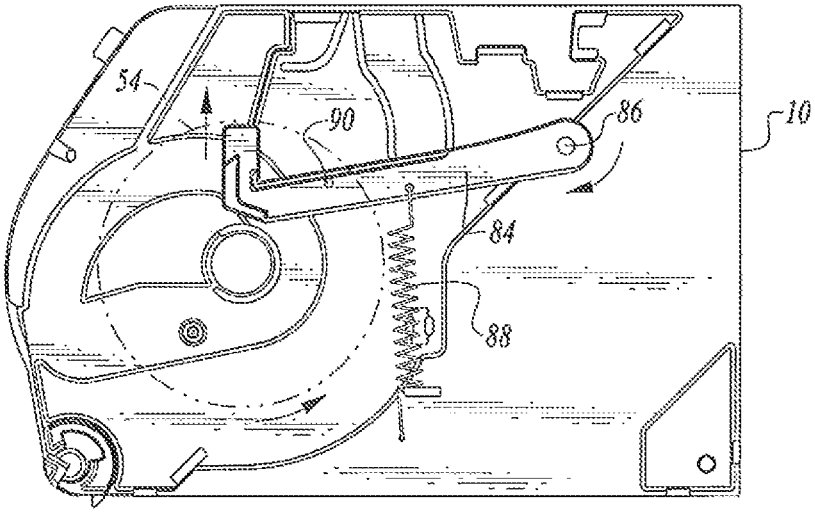
FIGS. 22-26 are views illustrating the knob and post rotated to different positions, the post moving a spring biased pivoted stop arm to different positions, the pivoted stop arm being used to temporarily stop rotation of the toweling support roller during operation of the dispenser.
Figure 23:
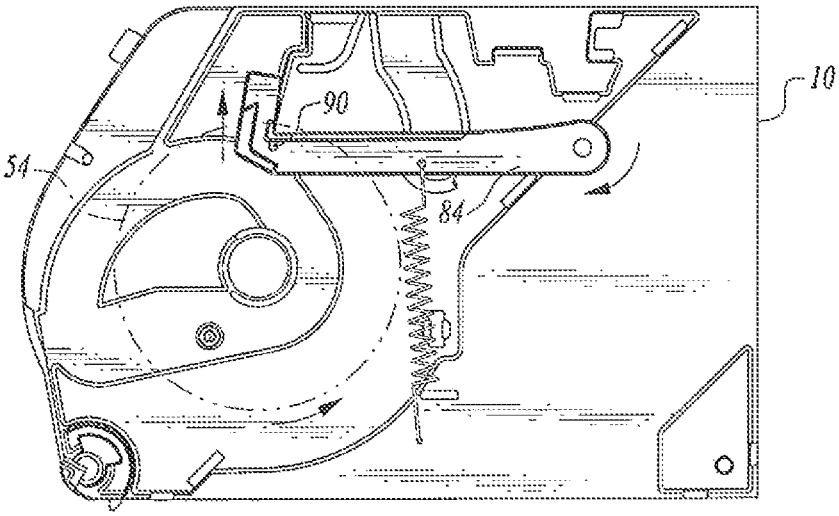
Figure 24:
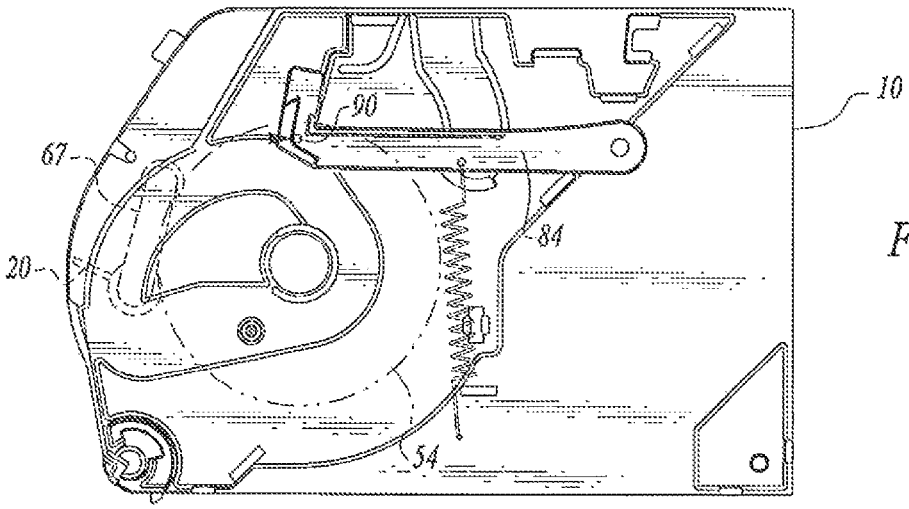

FIGS. 22 and 23 show the knob rotating and the post 90 engaging the underside of a top portion of the pivoted stop arm causing the stop arm to pivot and lift upwardly. When the knob post reaches the position shown in FIG. 24, momentary engagement between the post and arm briefly stops rotation of the toweling support roller, the knob post 90 being in lock up position. FIG. 24 shows the tear blade position and orientation by phantom lines at the point where the toweling support roller rotation is stopped by the arm and post.

Figure 25:
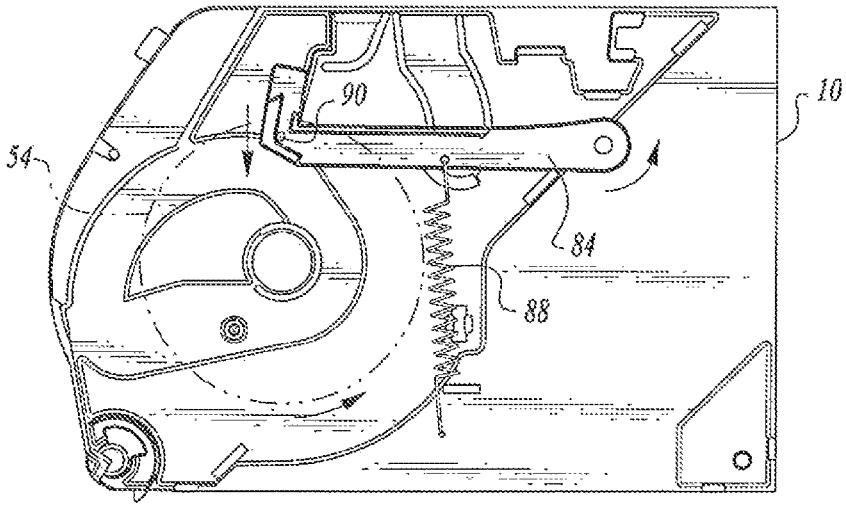
Figure 26:
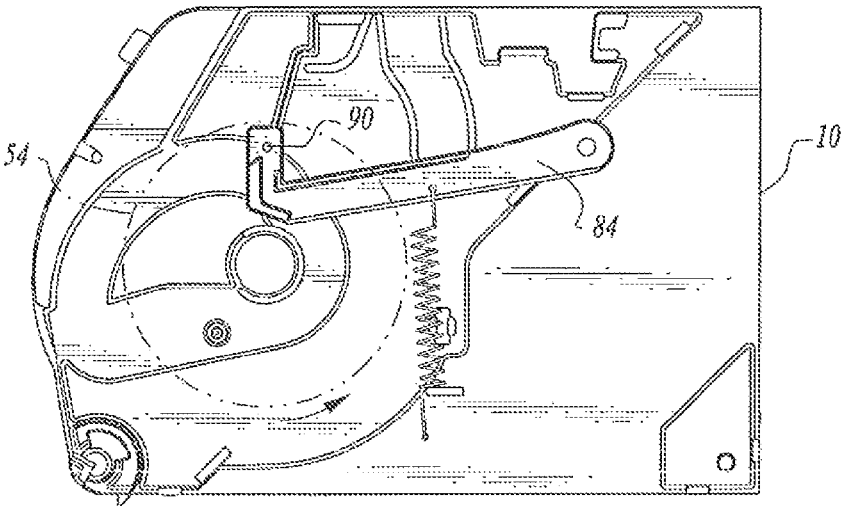
Figure 27:
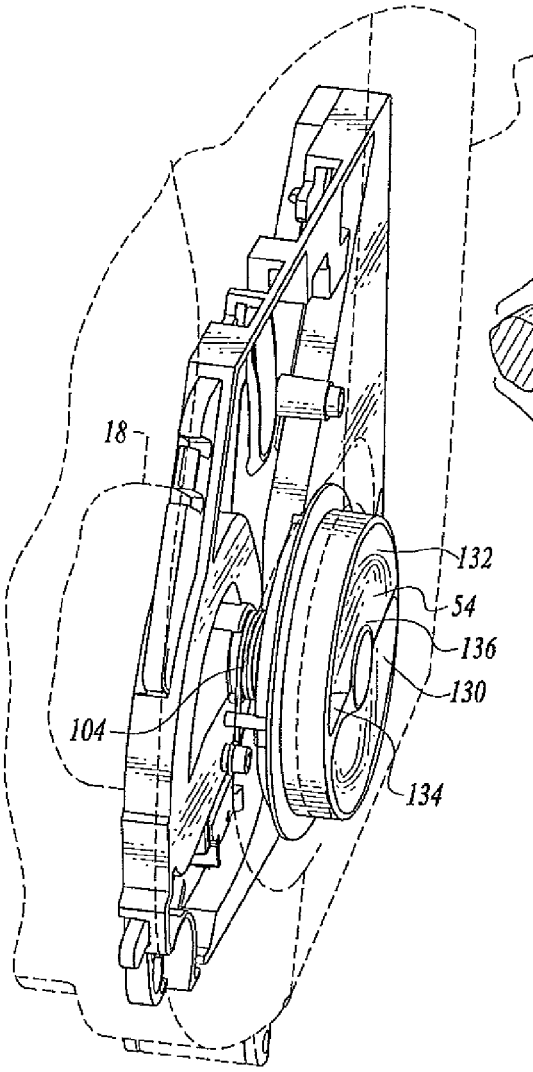
FIG. 27 is a perspective view of a rotatable handle and one-way clutch mechanism of the invention.
Figure 28:
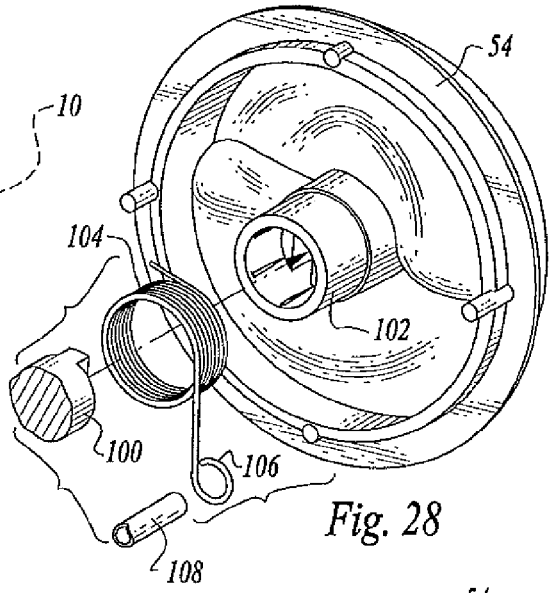
FIG. 28 is an enlarged, exploded perspective view of the inside of the handle and a spring employed in the one-way clutch.
Figure 29:
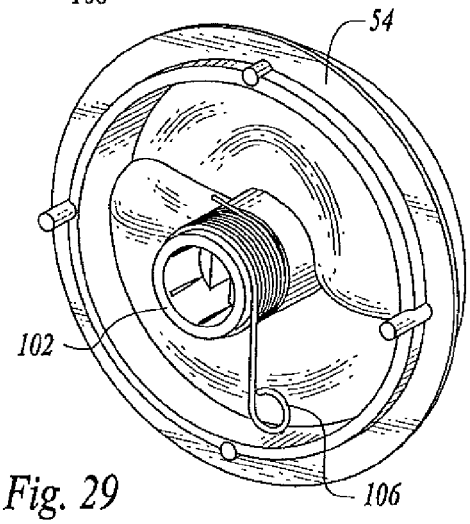
FIG. 29 is a view similar to FIG. 28 with the spring connected to the handle.

After the toweling support roller has stopped, the arm drops out of the way as shown in FIG. 25. FIG. 26 shows return of the pivoted stop arm to its lower (unlocking) position and the post positioned to exit the pivoted stop arm during continued rotation of the toweling support roller and post 90. The toweling support roller is now free to be rotated by the motor, a user pulling on the exposed sheet or a user rotating the knob.

The pivoted stop arm has the same stop position for either the first or second (paper hidden or paper exposed) modes of operation. However, the stop would have to be in a different position to be used with the hybrid or third operation mode. If the pivoted stop arm is installed in the multi-function paper towel dispenser, only the exposed and hidden modes would work. In that case, the dispenser likely would be made available without the hybrid or third mode operational feature. However, the stop arm could be a desirable feature for a stand alone hybrid system as taught by co-pending U.S. patent application Ser. No. 12/290,220, as well. For example, if a user pulls the sheet too hard, the momentum of the toweling support roller might be sufficient to advance an extra sheet which some customers do not like. The arm would stop toweling support roller rotation before the electric switch 32 associated with hybrid operation is actuated.

The invention claimed is:

1. A paper toweling dispenser including, in combination:

a housing;

a rotatable toweling support roller within said housing for receiving and transporting paper toweling;

an electric motor for driving said toweling support roller in a single predetermined direction of rotation;

an electronic control for controlling operation of said electric motor and rotation of said toweling support roller by said electric motor in said single predetermined direction of rotation;

a rotatable manually engageable handle connected to said toweling support roller; and a one-way clutch operatively associated with said handle enabling said handle upon application of manual force thereto to rotate about an axis of rotation and independently drive and rotate said toweling support roller only in said single predetermined direction of rotation when said electric motor is not driving said toweling support roller, rotation of said toweling support roller in said single predetermined direction of rotation transporting any toweling supported by said toweling support roller to dispense said toweling, said one-way clutch comprising a circular member having a plurality of spaced projections having projection distal ends disposed thereabout defining notches and a pivotally mounted pawl freely pivotal in a plane orthogonal to said axis of rotation adjacent to said circular member engageable with said projections and having a projection engagement pawl portion positionable in notches formed by adjacent projections to prevent rotational movement of said handle and said toweling support roller in a rotational direction other than said single predetermined direction of rotation, said rotatable manually engageable handle having a manually engageable outer handle portion located outside said housing spaced from said circular member and said projections coaxially rotatable with said circular member and a non-manually engageable inner handle portion rotatable with said outer handle portion positioned between said projections and said outer handle portion, said inner handle portion comprising a circular wall having an inner wall surface extending radially outwardly in a direction orthogonal to said axis of rotation and extending beyond the projection distal ends, said circular member affixed to the inner wall surface and rotatable with said inner handle portion, said pivotally mounted pawl biased solely by gravity with the projection engagement pawl portion thereof urged toward said circular member and said projections positioned so that said projection engagement pawl portion extends toward said circular member closely alongside the inner wall surface of said circular wall in a plane orthogonal to said axis of rotation and aligned with the plane of said circular member, said circular wall and placement thereof relative to the pawl operable to protect and shield the pawl at the location of engagement with the projections and stabilize the pawl.

* * * * *